US005973456A

United States Patent [19]

Osada et al.

[11] Patent Number: 5,973,456

[45] Date of Patent: Oct. 26, 1999

[54] ELECTROLUMINESCENT DISPLAY DEVICE HAVING UNIFORM DISPLAY ELEMENT COLUMN LUMINOSITY

[75] Inventors: Masahiko Osada, Hekinan; Ken Nishioka, Toyoake; Hiroyuki Kishita, Kariya; Tadashi Hattori, Okazaki, all of Japan

[73] Assignee: Denso Corporation, Kariya, Japan

[21] Appl. No.: 08/787,049

[22] Filed: Jan. 28, 1997

[30] Foreign Application Priority Data

Jan. 30, 1996 [JP] Japan ..... 8-014481

[51] Int. Cl.[6] ..... G09G 3/28

[52] U.S. Cl. ..... 315/169.1; 315/169.3; 315/169.4; 345/55; 345/76

[58] Field of Search ..... 315/169.1, 169.3, 315/169.4, 169.2; 345/55, 76, 77

[56] References Cited

U.S. PATENT DOCUMENTS

| | | | |
|---|---|---|---|
| 3,566,014 | 2/1971 | Norem | 315/169.3 |
| 3,601,532 | 8/1971 | Bitzer | 315/169.4 |
| 3,674,928 | 7/1972 | Yoshiyama et al. | 315/169.1 |
| 4,686,426 | 8/1987 | Fujioka et al. | 315/169.3 |
| 4,859,910 | 8/1989 | Iwakawa et al. | 315/169.1 |
| 4,951,041 | 8/1990 | Inada et al. | 340/767 |
| 4,983,885 | 1/1991 | Fujioka et al. | 315/169.3 |
| 5,075,596 | 12/1991 | Young et al. | 315/169.3 |
| 5,231,382 | 7/1993 | Tanaka | 340/771 |
| 5,739,641 | 4/1998 | Nakamura et al. | 315/169.1 |

FOREIGN PATENT DOCUMENTS

| | | |
|---|---|---|
| 61-251899 | 11/1986 | Japan . |
| 62-069294 | 3/1987 | Japan . |
| 1-117297 | 5/1989 | Japan . |
| 1-124997 | 5/1989 | Japan . |
| 1-177075 | 7/1989 | Japan . |
| 6-038360 | 5/1994 | Japan . |
| 6-186929 | 7/1994 | Japan . |

OTHER PUBLICATIONS

NEC Data Sheet "MOS Integrated Circuit $\mu$ PD16302".

*Primary Examiner*—Don Wong
*Assistant Examiner*—Wilson Lee
*Attorney, Agent, or Firm*—Pillsbury Madison & Sutro LLP

[57] ABSTRACT

To eliminate uneven luminance between columns, and along with this, to eliminate uneven luminance also among EL elements in several columns in an EL display device for performing matrix display, in a matrix type EL display device in which a scan voltage is sequentially applied to scan electrodes and EL elements are caused to electroluminesce by this scan voltage and a data voltage, a pulse width of the scan voltage is kept uniform, and together with this, a charging period for the EL elements is varied in accordance with a number of light emitting pixels in a line scanned and driven to eliminate uneven luminance between columns. Additionally, a holding period for holding a charging voltage is provided to alleviate differences in terminal voltages among the EL elements due to wiring resistance delay and to eliminate uneven luminance among the EL elements.

19 Claims, 7 Drawing Sheets

POSITIVE FIELD
NEGATIVE FIELD
FIG. 3A 51,62
FIG. 3B 52,61

Vr
Vm
0
-Vr+Vm

Vr
Vm
0
-Vr+Vm

Vm
0

Vr
0
-Vr

Vm
Vr-Vm
0
-Vm
-Vr+Vm

Vr
L1
0

Vm
L2
-Vr+Vm (NEGATIVE FIELD)
(POSITIVE FIELD)
FIG.6A FRAME 5V 0V
FIG.6B HSYNC 5V 0V
FIG.6C CHG 5V 0V
FIG.6D MAX 5V 0V
FIG.6E DIS 5V 0V
FIG.6F OE 5V 0V
FIG.6G PULSE 5V 0V
FIG.6H PO "H" "L"
FIG.6I BLK "H" "L"

1 HORIZ. SYNC. PD.
CHG.
DISCH.
CHG.
DISCH.
Vr
Vm
0
(SCAN VOLT.)
-Vr+Vm
01="L"
01="Z"
01="H"
PULSE WIDTH
01="H"
01="Z"
01="L"
PULSE WIDTH

ELECTROLUMINESCENT DISPLAY DEVICE HAVING UNIFORM DISPLAY ELEMENT COLUMN LUMINOSITY

CROSS-REFERENCE TO RELATED APPLICATION

The present application is related to and claims priority from Japanese Patent Application No. Hei 8-14481, incorporated herein by reference.

BACKGROUND OF THE INVENTION

1. Field of the Invention

This invention relates to an EL display device which drives an EL element to emit light.

2. Description of Related Art

Various devices which have a plurality of scan electrodes and a plurality of data electrodes arranged in a matrix to perform display with an EL element of this type have previously been proposed. In such a matrix type display device, there is a problem where uneven luminance between columns occurs due to fluctuation in a number of pixels caused to emit light per column. The device disclosed in Japanese Unexamined Patent Publication No. Hei 7-48137 attempts to eliminate such uneven luminance by changing the pulse width of scan voltage.

However, because wiring resistance exists in scan electrodes, for the terminal voltage of the several pixels of a scan electrode, the predetermined voltage comes to be applied increasingly less as the pixel is located increasingly farther from the scan electrode terminal due to delay by wiring resistance. Because of this, even when pulse width of the scan voltage applied to the scan electrodes is controlled, as in the device described in the foregoing Japanese Unexamined Patent Publication No. Hei 7-48137, uneven luminance due to fluctuation in terminal voltage among pixels in several columns still cannot be eliminated. Delay due to wiring resistance exists even when aluminum is employed as the electrode material, and is even greater in the case of a transparent electrode composed of ITO, ZnO, or the like.

Further, to eliminate uneven luminance in each of several scan lines, the system described in Japanese Unexamined Patent Publication No. 7-48137 varies a scan signal period in accordance with a number of light-emitting pixels. This is done by controlling on and off states of switches in scan-side power supply circuits in that device to control the voltage supplied to scan-side transistors. In this case, voltages of 0 and 190 V are alternatingly applied on the line (hereinafter termed "power-supply line") connecting one of the switches to the scan-side transistors. Here, referring to "H" in FIG. 6 of Japanese Unexamined Patent Publication No. 7-48137, the time between the scan-side line (PT1) and the scan-side line (PT3) is 80 $\mu$s (see PSC in the drawing), and so the cycle in which 0 V and 190 V are alternated is 12.5 kHz. When high voltage alternate in a short cycle, noise is generated, and there is a problem of interference with peripheral circuitry.

SUMMARY OF THE INVENTION

In view of the above-described problems of the prior art, it is an object of the present invention to eliminate uneven luminance effects in an EL display.

The above object is achieved according to a first aspect of the present invention by providing a system in which, after an EL element has been charged for a charging period, the charging voltage is held for a holding period, and a voltage pulse is applied to electrodes on one side. The number of EL elements emitting light is detected, and the charging period is varied in accordance with this detected number of EL elements.

Consequently, the charging period is established according to the number of EL elements which are to emit light, and so uneven luminance between electrodes can be eliminated with the charge quantity with which the EL elements are charged remaining substantially the same irrespective of the number of EL elements emitting light. Additionally, differences in terminal voltage due to wiring voltage among a plurality of EL elements on one electrode are alleviated by holding the charging voltage after the charging period, and uneven luminance among several EL elements at one electrode also can be eliminated.

According to a second aspect of the present invention, the overall period of the charging period and the holding period is uniform so that pulse width can be made to be a uniform large value in comparison with prior art devices which vary the pulse width, and differences in terminal voltage due to the above-mentioned wiring resistance delay can be reduced. Further, the charging period may be established at a minimum period or more so that uniform luminance can be assured even in a case where the number of EL elements emitting light is small. Preferably, the charging period is restricted to a maximum period or less so that the holding period after the charging period can be ensured. Moreover, the charging charge quantity may be varied during the charging period.

According to another aspect of the present invention, an EL display device performing matrix drive set a scan voltage to a uniform pulse width and varies the charging period according to the number of EL elements emitting light. Additionally, the holding of the charging voltage during the holding period can be performed by causing the electrodes to go to high impedance.

According to yet another aspect of the present invention, the potential of the power supply line is caused to be uniform while overwriting the several fields, and is controlled to a scan signal period by actuation timing of the first switch (scan-side transistor 21*a*) and the second switch (scan-side transistor 21*b*) according to the number of light-emitting pixels.

Consequently, uneven luminance in each of the several scan lines is eliminated, and simultaneously thereto, noise generated by the power-supply line also can be reduced.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which:

FIGS. 3A–3M are drive timing charts for the device showing in FIG. 1;

FIGS. 5A–50 are signal waveform diagrams showing signal waveforms at several portions in the circuit shown in FIG. 4;

FIGS. 6A–6J are signal waveform diagrams showing signal waveforms at several portions in the circuits shown in FIGS. 4 and 7;

FIG. 7 is a schematic diagram of a scan driver IC according to the first embodiment; and FIG. 8 is a schematic diagram of a second preferred embodiment of the present invention.

DETAILED DESCRIPTION OF THE PRESENTLY PREFERRED EXEMPLARY EMBODIMENTS

Figure 1:
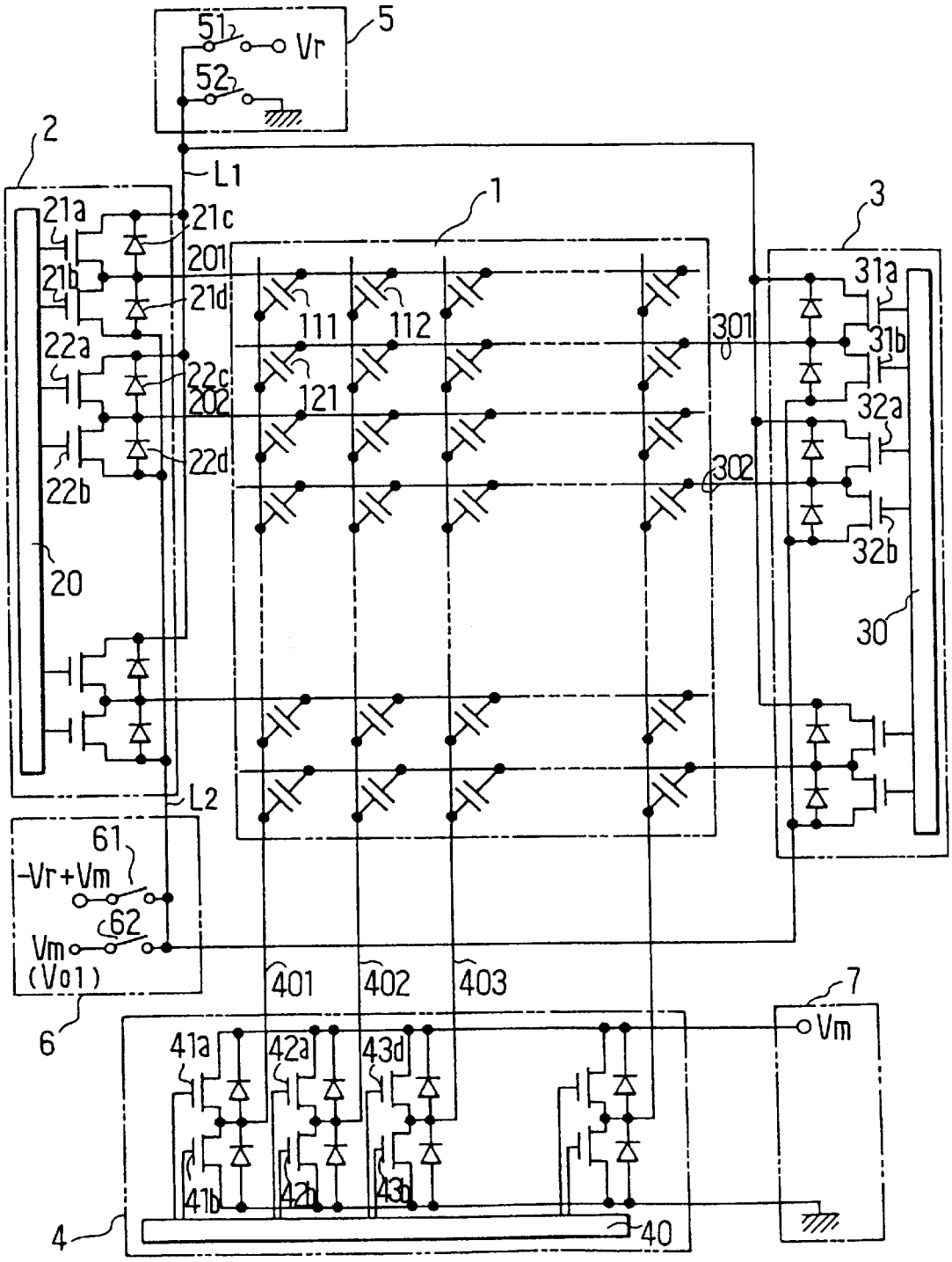
FIG. 1 is a structural view of an EL display device according to a first preferred embodiment of the present invention.
Figure 2:
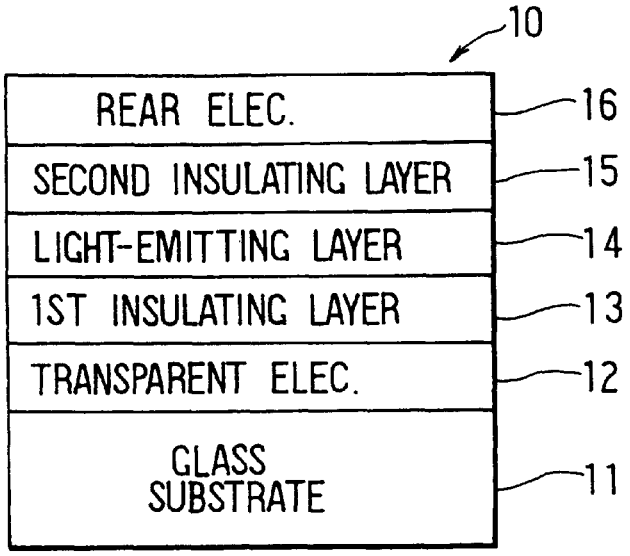
FIG. 2 is a typical cross-sectional structural view showing the structure of an EL element in the first embodiment.

FIG. 1 shows the overall structure of an EL display device according to a first preferred embodiment of the present invention, and FIG. 2 shows a typical cross-sectional structure of an EL element in such a device.

In FIG. 2, an EL element 10 is made up of a transparent electrode 12, a first insulating layer 13, a light emitting layer 14, a second insulating layer 15, and a rear electrode 16 formed by lamination on a glass substrate 11, and emits light responsive to an alternating current drive voltage pulse applied between the transparent electrode 12 and the rear electrode 16. In FIG. 2, light is emitted through the glass substrate 11. Further, light can be extracted in both the upper and lower directions in the drawing when the rear electrode 16 is a transparent electrode.

An EL display panel 1 shown in FIG. 1 has a plurality of transparent electrodes 12 and rear electrodes 16 in columns and rows as data electrodes and scan electrodes, and performs matrix display. In specific terms, odd numbered scan electrodes 201, 202, 203 . . . and even numbered scan electrodes 301, 302 . . . are formed in the row direction, and data electrodes 401, 402, 403 . . . are formed in the column direction.

EL elements 111, 112 . . . 121 . . . are formed as pixels in intersecting regions of the scan electrodes 201, 301, 202, 302 . . . and the data electrodes 401, 402, 403 . . . The EL elements are capacitative elements and so are indicated by capacitor symbols in the drawing.

Scan electrode driver circuits 2 and 3 and a data electrode driver circuit 4 are provided to perform display drive for this EL display panel 1.

The scan electrode driver circuit 2 is a push-pull type drive circuit having P-channel FETS 21*a*, 22*a* . . . and N-channel FETs 21*b*, 22*b* . . . connected to the odd-numbered scan electrodes 201, 202 . . . and applies scan voltage to the odd-numbered scan electrodes 201, 202 . . . in accordance with output from a control circuit 20.

Additionally, parasitic diodes 21*c*, 21*d*, 22*c*, 22*d* . . . are formed in each of the FETs 21*a*, 21*b*, 22*a*, 22*b* . . . and voltage of the scan electrodes is established at a desired reference voltage.

The scan electrode driver circuit 3 is of similar structure and has a control circuit 30, P-channel FETs 31*a*, 32*a* . . . and N-channel FETs 31*b*, 32*b* . . . and supplies a scanning voltage (i.e., voltage pulses) to the even-numbered scan electrodes 301, 302 . . .

The data electrode driver circuit 4 also similarly has a control circuit 40, P-channel FETs 41*a*, 42*a* . . . and N-channel FETs 41*b*, 42*b* . . . and supplies data voltage (i.e., display voltage) to the data electrodes 401, 402, 403 . . .

Scan voltage supply circuits 5 and 6 are provided to supply scan voltage to the scan electrode driver circuits 2 and 3. The scan voltage supply circuit 5 has switching elements 51 and 52 and, in accordance with on/off states thereof, supplies a direct current voltage (i.e., a write voltage) Vr or a ground voltage to a P-channel FET source-side common line L1 in the scan electrode driver circuits 2 and 3.

The scan voltage supply circuit 6 has switching elements 61 and 62 and, in accordance with on/off states thereof, supplies a direct current voltage −Vr+Vm to an N-channel FET source side common line L2 in the scan electrode driver circuits 2 and 3.

Additionally, a data voltage supply circuit 7 is provided with respect to the data electrode driver circuit 4. The data voltage supply circuit 7 supplies a direct current voltage (i.e., a modulation voltage) Vm to a P-channel FET source-side common line of the data electrode driver circuit 4 and supplies a ground voltage to an N-channel FET source-side common line of the data electrode driver circuit 4.

According to the foregoing structure, it is necessary to apply an alternating current pulse voltage between the scan electrode and the data electrode to cause the EL element which is to emit light, and because of this, a pulse voltage having alternating positive and negative polarities in each field is created at each of the several scan lines to drive the display. Operation in positive and negative fields will be described hereinafter with reference to the timing charts shown in FIGS. 3A–3M.

Positive Field

The switching elements 51 and 62 are switched on, and the switching elements 52 and 61 are switched off. At this time, the reference voltage of the scan electrodes 201, 301, 202, 302 . . . becomes the offset voltage Vm due to operation of the parasitic diodes of the FETs of the scan electrode driver circuit 2 and 3. Additionally, the FETs 41*a*, 42*a*, 43*a* . . . of the data electrode driver circuit 4 are switched on, and the voltage of the data electrodes is set to Vm. In this state, voltage applied to all EL elements becomes 0 V, and so the EL elements do not emit light.

Thereafter, electroluminescence operation in the positive field is started. Firstly, the P-channel FET 21*a* of the scan electrode driver circuit 2 connected to the scan electrode 201 of the first line is switched on, and voltage of the scan electrode 201 is set to Vr. Additionally, output stage FETs of the scan electrode driver circuits 2 and 3 connected to other scan electrodes are all switched off, and these scan electrodes enter a floating state.

Additionally, among the data electrodes 401, 402, 402 . . . , a P-channel FET of the data electrode driver circuit 4 connected to a data electrode of an EL element which is to emit light is switched off and an N-channel FET thereof is switched on, and a P-channel FET of the data electrode driver circuit 4 connected to a data electrode of an EL element which is not to emit light is switched on and an N-channel FET thereof is switched off.

Because of this, the voltage of the data electrode of the EL element which is to emit light becomes the ground voltage, and so the EL element emits light. Additionally, voltage Vm of the data electrode of the EL element which is not to emit light remains unchanged at Vm, and voltage of Vr−Vm is applied to the EL element. This voltage of Vr−Vm is established to be lower than the threshold voltage, and the EL element does not emit light.

The timing chart of FIGS. 3A–3M show a state where the P-channel FET 41*a* of the data electrode driver circuit 4 is switched off, the N-channel FET 41*b* thereof is switched on, voltage Vr is applied to the EL element 111, and the EL element 111 emits light.

Thereafter, charge accumulated in the EL element on the scan electrode 201 is discharged by switching off the P-channel FET 21*a* of the scan electrode driver circuit 2 connected to the scan electrode 201 of the first line and switching on the N-channel FET 21*b* thereof.

Next, the P-channel FET 31*a* of the scan electrode driver circuit 3 connected to the scan electrode 301 of the second line is switched on, and voltage of the scan electrode 301 is set to Vr. Additionally, output stage FETS of the scan electrode driver circuits 2 and 3 connected to other scan electrodes are all switched off, and these scan electrodes enter a floating state.

Additionally, electroluminescence drive of the EL elements of the second line is performed similarly to the foregoing by setting the voltage levels of the data electrodes 401, 402, 402 . . . to voltage levels corresponding to an EL element which is to emit light or to an EL element which is not to emit light.

The timing chart of FIGS. 3A–3M show a state wherein the P-channel FET 41*a* of the data electrode driver circuit 4 is switched on, the N-channel FET 41*b* thereof is switched off, voltage of the data electrode 401 is set to Vm, a voltage Vr−Vm is applied to the EL element 121, and the EL element 121 does not emit light.

Thereafter, charge accumulated in the EL element on the scan electrode 301 is discharged by switching off the P-channel FET 31*a* of the scan electrode driver circuit 3 connected to the scan electrode 301 of the second line and switching on the N-channel FET 31*b* thereof.

Thereafter, line-sequential scanning, wherein the above-described operation is repeated until the final scan line is reached, is performed similarly.

Negative Field

The switching elements 52 and 61 are switched on, the switching elements 51 and 62 are switched off, and operation similar to the operation in the positive field is performed with polarity reversed. At this time, the reference voltage of the scan electrodes becomes ground voltage. Additionally, the FETs 41*b*, 42*b*, 43*b* . . . of the data electrode driver circuit 4 are switched on, and voltage of the data electrodes is set to ground voltage. In this state, voltage applied to all EL elements becomes 0 V, and so the EL elements do not emit light.

Thereafter, line-sequential scanning similar to the positive field is performed for the negative field as well.

In this case, −Vr+Vm is applied to the scan electrode of the line where display selection is performed. On the data electrode side, oppositely to the positive field, voltage of a data electrode which is to emit light is set to Vm, and voltage of a data electrode which is not to emit light remains unchanged at ground voltage.

Consequently, when voltage Vm is applied to a data electrode with respect to a scan electrode to which a voltage of −Vr+Vm is applied, a voltage of −Vr is applied to an EL element corresponding thereto, and the EL element emits light. Furthermore, when the voltage of a data electrode is ground voltage, a voltage of −Vr+Vm, which is lower than threshold voltage, is applied to the EL element, and so the EL element does not emit light.

Accordingly, one cycle of display operation is completed by drive of the above-described positive and negative fields, and this is performed repeatedly.

The structure of the scan electrode drive circuits 2 and 3 to output the foregoing scan voltage will be described next.

According to this embodiment, a predetermined charge for charging an EL element and a holding period for holding the charging voltage thereof are provided to output the scan voltage.

Figure 4:
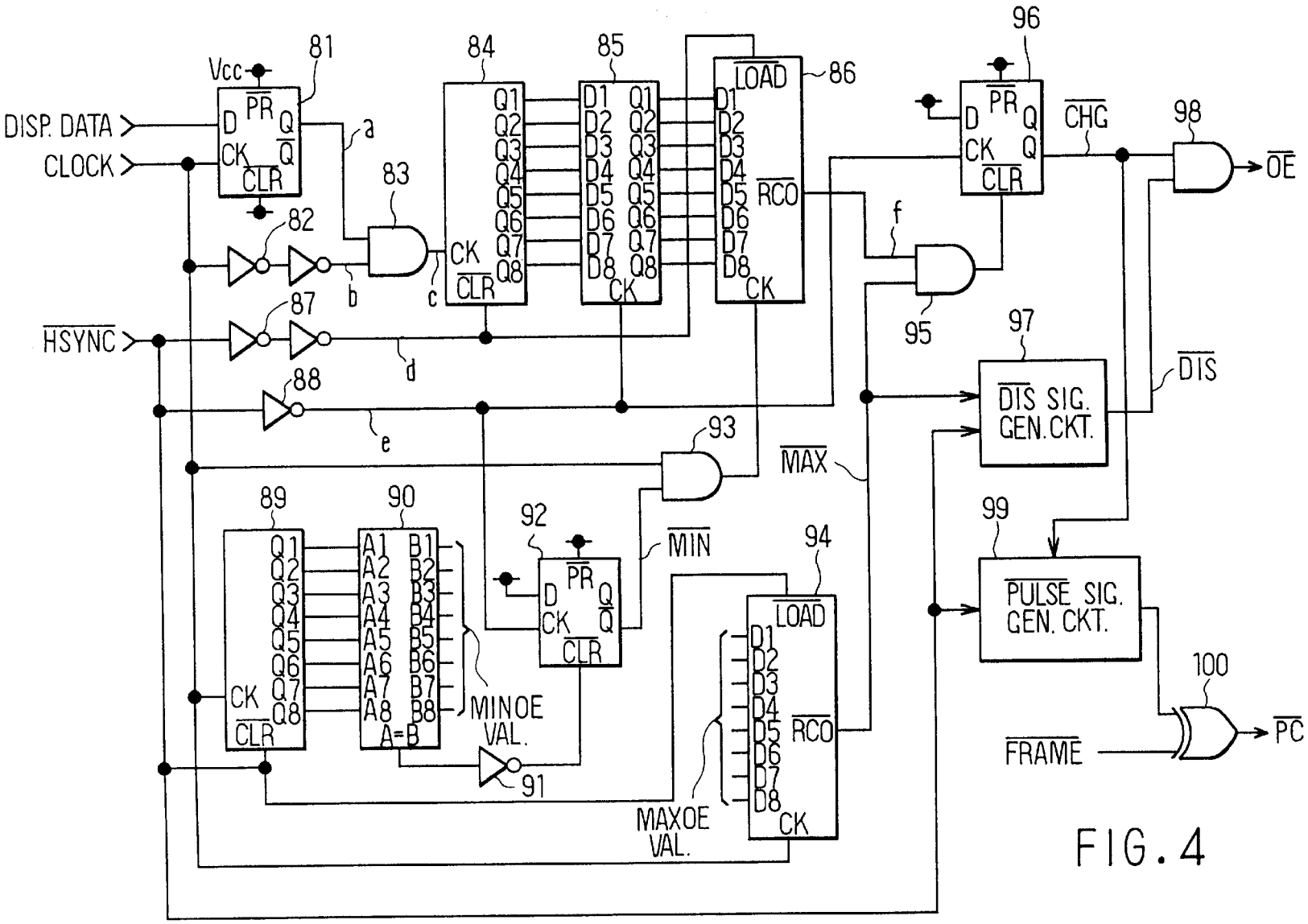
FIG. 4 is a schematic diagram of a portion of the scan electrode drive circuits 2 and 3 in the first embodiment.

The circuit structure for establishing the foregoing charging period and holding period to generate the scan voltage of the subsequent line is shown in FIG. 4. Additionally, the signal waveforms of the several portions in FIG. 4 are shown in FIGS. 5A–50.

Display data (see FIG. 5A) for performing display of the subsequent line is input to a D terminal of a D flip-flop 81. This data is a digital signal wherein a signal which becomes 5 V during light emission and 0 V during non-emission of light is sent in time segments synchronized with a CLOCK signal (see FIG. 5B).

Figures 5A, 5B, 5C, 5D, 5E, 5F, 5G, 5H, 5I, 5J, 5K, 5L, 5M, 5N, 5O:
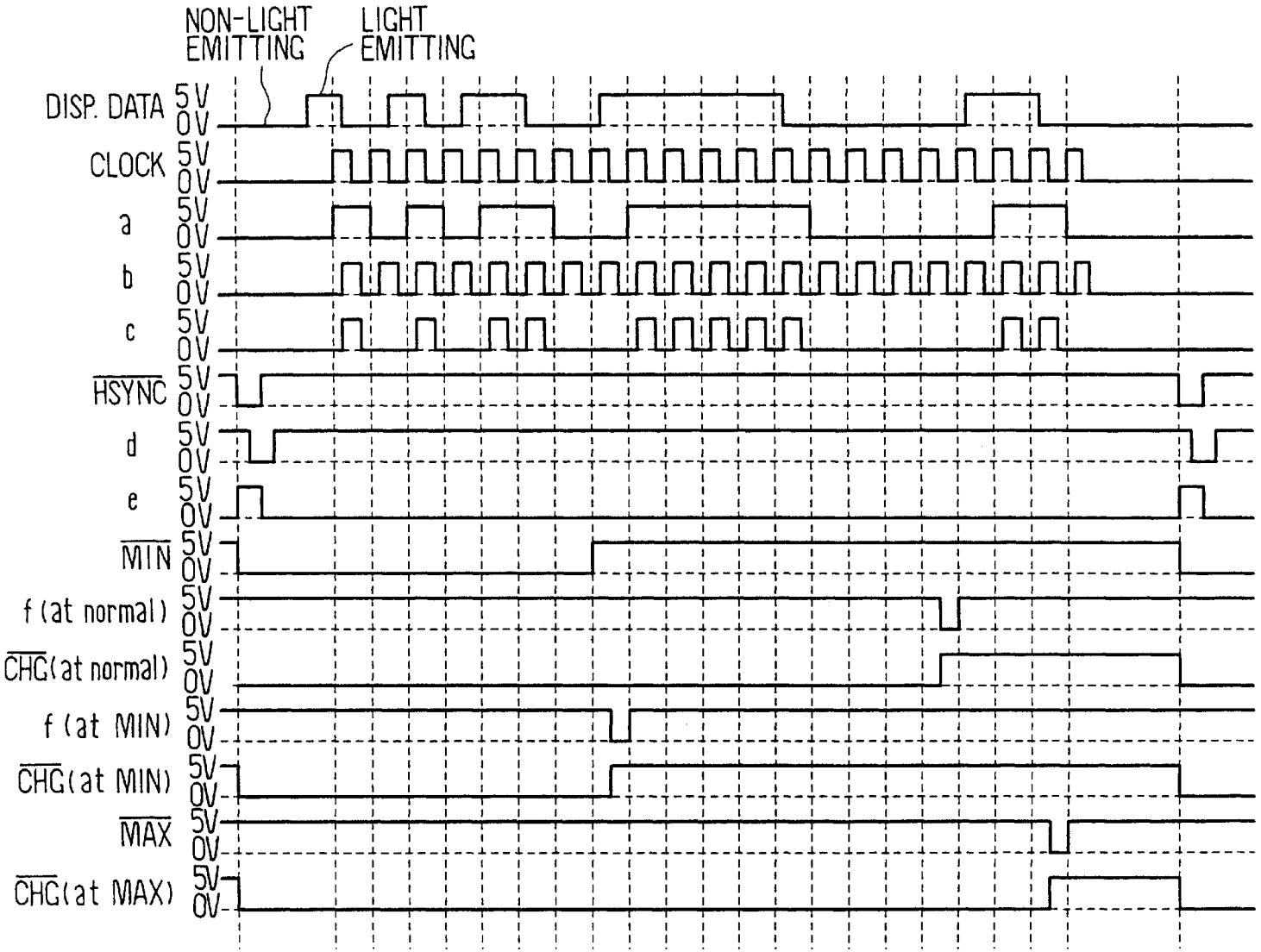
Figure 6J:
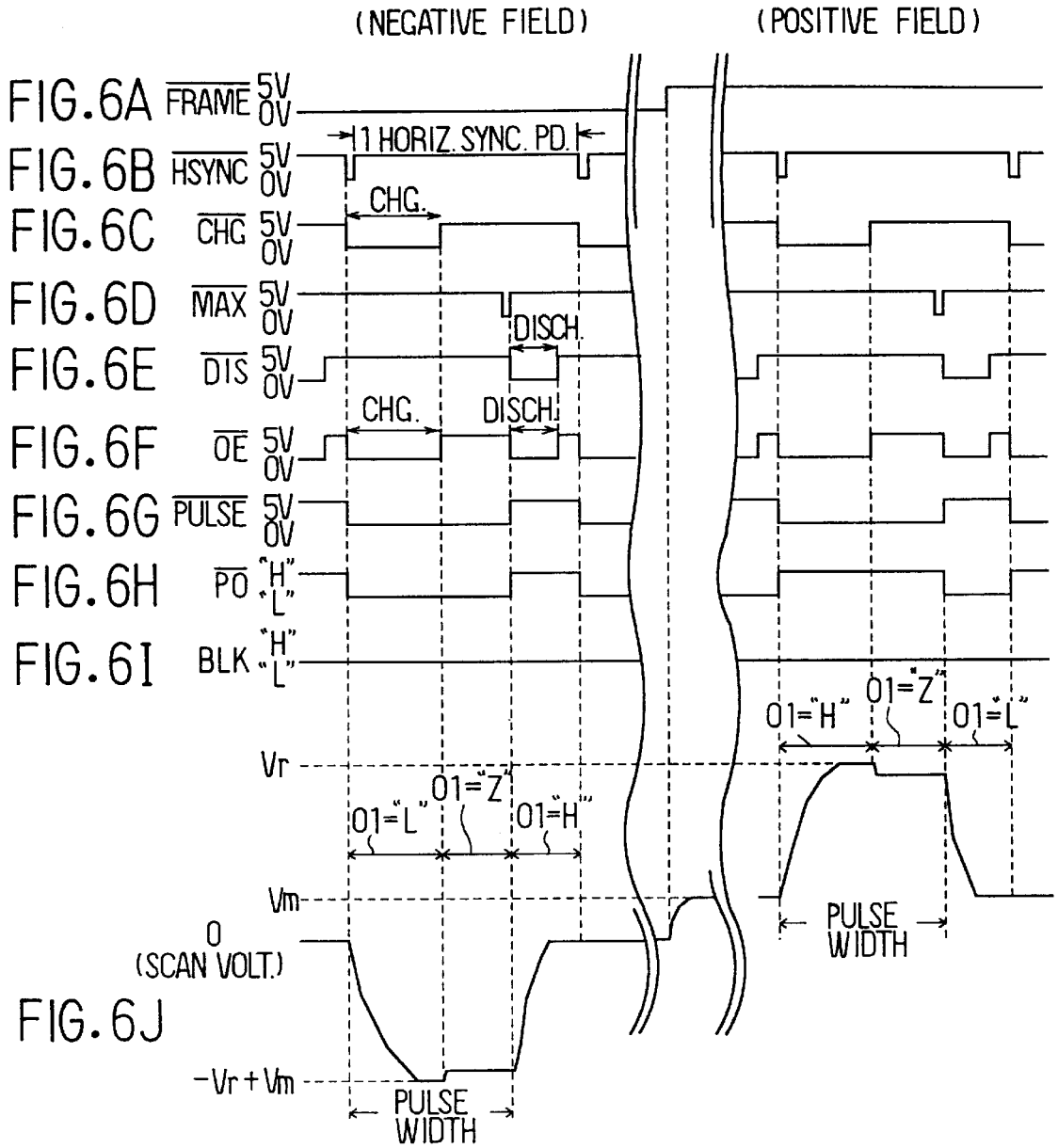

The D flip-flop 81 outputs the display data input to the D terminal from the Q terminal with the timing of the CLOCK signal, as signal a (see FIG. 5C). An AND gate 83 ANDs the signal a and a signal b (see FIG. 5D) for which the CLOCK signal has been delayed by a delay circuit 82, and outputs a signal c (see FIG. 5E). A counter 84 counts the signals c from the AND gate 83. The count value thereof represents the number of pulses of display data, that is to say, the number of EL elements (i.e., the number of light emitting pixels) which are to emit light in the subsequent line.

The count value of the counter 84 is stored in a latch circuit 85 by a signal e (see FIG. 5H) produced by inverting, in an inverter 88, an HSYNC bar signal (see FIG. 5F) (hereinafter, "bar" will represent a negative logic signal) which is a horizontal synchronization signal. Thereafter, the counter is cleared and readied for the operations of the subsequent line by a signal d (see FIG. 5G) produced by delaying the HSYNC bar signal with a delay circuit 87, and along with this, a counter 86 is preset with the count value stored in the latch circuit 85.

Meanwhile, a counter 89 counts the CLOCK signal. This count value is compared by a comparator circuit 90 with a previously established MINOE value (i.e., an established value for a minimum charging period). Accordingly, when the count value of the counter 89 and the MINOE value become equal, a pulse signal is output from the comparator circuit 90 and a D flip-flop 92 is cleared via a NOT circuit 91. As a result of this, a MIN bar signal (see FIG. 51) from a Q bar terminal of the D flip-flop 92 goes to high level, driving an AND gate 93 high, and the CLOCK signal is output to a clock (CK) terminal of the counter 86.

The counter 86 is decremented from the preset count value by the CLOCK signal, and when the counted-down value reaches 0, a signal f goes to low level, that is, a carrier out signal is output.

Additionally, counter 94 is decremented by the CLOCK signal from a MAXOE value (i.e., an established value for the maximum charging period) preset by the falling edge of the HSYNC bar signal. Accordingly, when a carrier out signal is generated from the counter 94, a MAX bar signal (see FIG. 5N) goes low.

According to the foregoing structure, the counter 86 is preset with a count value corresponding to the number of light emitting pixels in the subsequent line, and after the foregoing MIN bar signal has gone to a high level, decrementing of the preset value thereof is started. Accordingly, when a carrier out signal is generated from the counter 86, the signal f goes low.

At this time, when the number of light emitting pixels is not a maximum value and the MAX bar signal remains unchanged at a high level, a low level signal is output from an AND circuit 95 and a D flip-flop 96 is cleared, and so a high level CHG bar signal is output from a Q bar terminal thereof. That is to say, when the number of light emitting pixels is a predetermined number which is smaller than the maximum value, the signal f goes low (see FIG. 5J) and the CHG bar signal goes high (see FIG. 5K) after the MIN bar signal has gone high and before the MAX bar signal goes low. In this case, the timing with which the CHG bar signal goes high changes in accordance with the number of light emitting pixels.

Additionally, when the number of light emitting pixels is 0 and the value preset to the counter 86 is 0, the signal f goes low due to the CLOCK signal after the MIN bar signal has gone high (see FIG. 5L), and the CHG bar signal goes high (see FIG. 5M). In a case where the number of light emitting pixels is greater than the maximum value, the MAX bar signal goes low before the signal f goes low, and so the CHG bar signal goes high (see FIG. 50).

As will be described later, the low level period of the CHG bar signal becomes the charging period for charging the EL elements, and so the greater the number of light emitting pixels, the longer the charging period. Additionally, a minimum period is ensured even when the number of light emitting pixels is nearly zero to obtain sufficient light emitting luminance. When the number of light emitting pixels is the maximum value or more, the charging period is restricted to the maximum value to ensure the holding period and a discharging period which will be described later.

Additionally, in FIG. 4, a DIS bar signal generator circuit 97 is provided to establish a discharging period. This DIS bar signal generator circuit 97 generates an output signal which falls in synchronization with the rising edge of the MAX bar signal, and outputs a rising DIS bar signal (see FIG. 6E) after the elapse of a uniform discharging period. Termination of the discharging period is determined by the elapse of a uniform time from the time of the falling edge of the HSYNC bar signal. Accordingly, the CHG bar signal and the DIS bar signal are ANDed by an AND circuit 98, and an OE signal (see FIG. 6F) which becomes an output enable signal is output.

Additionally, circuits for outputting a PC bar signal which becomes a polarity inversion signal to toggle the EL elements in the positive and negative fields, that is to say, a PULSE bar signal generator circuit 99 and an exclusive-OR circuit 100, are provided in FIG. 4.

The PULSE bar signal generator circuit 99 produces an output signal which falls in synchronization with the falling edge of the CHG bar signal, and outputs a PULSE bar signal (see FIG. 6G) which rises after the elapse of a predetermined time (i.e., a period from the time at which the HSYNC bar signal falls until prior to or simultaneous with the falling edge of the DIS bar signal). This PULSE bar signal and a FRAME bar signal (see FIG. 6A) corresponding to the polarity of the field are exclusive-ORed by the exclusive-OR circuit 100, and a PC bar signal (see FIG. 6H) is output.

A scan driver IC utilizing the foregoing OE bar signal and the PC bar signal to output the scan voltage will be described next.

Figure 7:
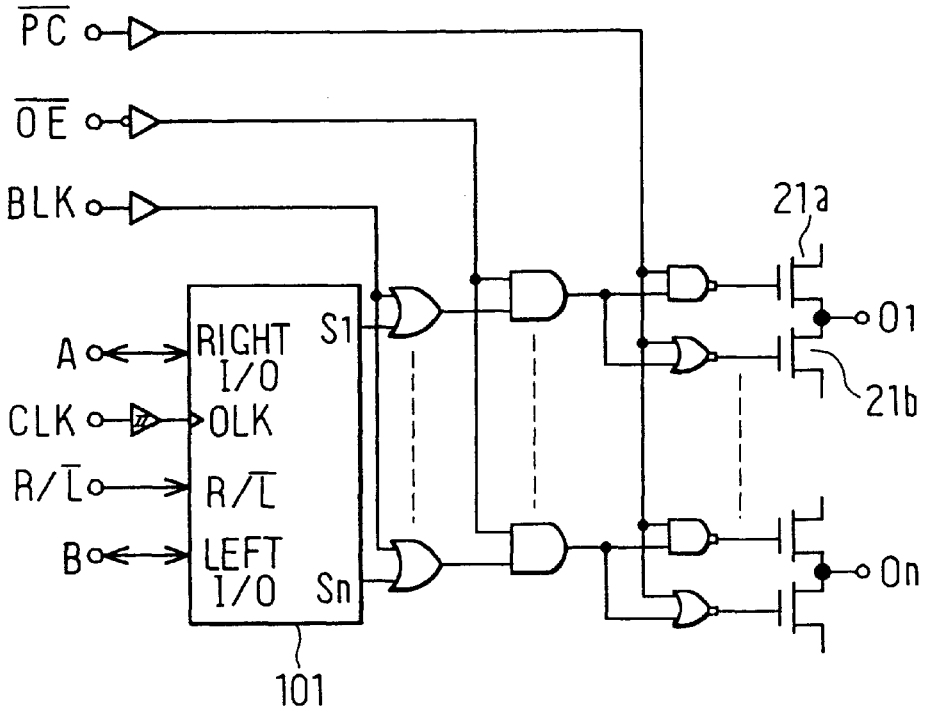
Figures 3C, 3D, 3E, 3F, 3G, 3H, 3I, 3J, 3K, 3L, 3M:
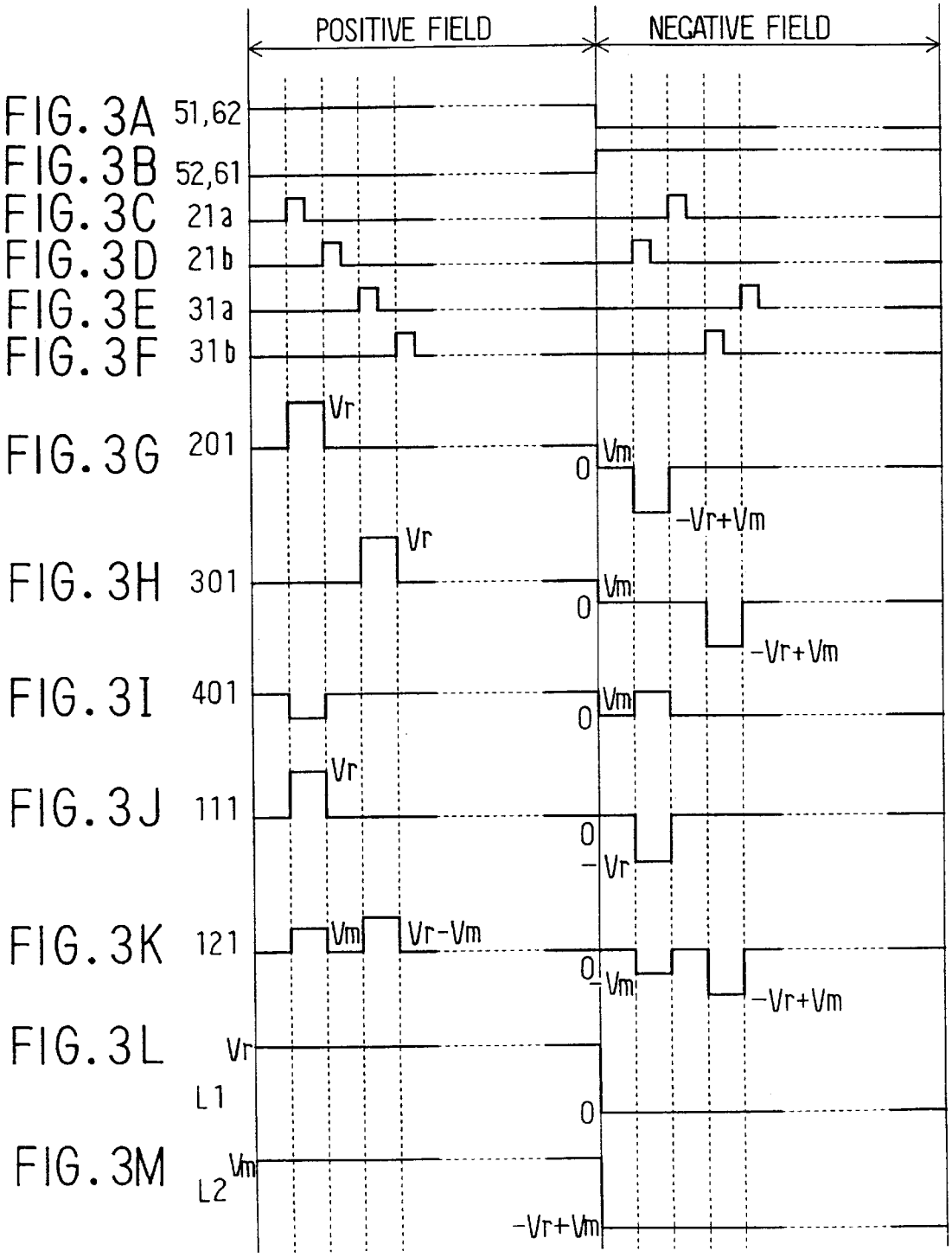

The structure thereof is shown in FIG. 7, which may be a commercially available scan driver IC such as a $\mu$PD16302. A shift register 101 sequentially shifts, with a CLK signal, a high level line selection signal output from a data input terminal A, and makes output in sequence from an $S_1$, terminal to an $S_n$ terminal. According to this embodiment, a blanking (BLK) signal is always low level.

TABLE 1 shows a truth table for the line selection signal, the BLK signal, the OE bar signal, the PC bar signal, and output signal O. Herein, "H" signifies high level, "L" signifies low level, "X" signifies either high or low, and "Z" signifies that all output is made high impedance.

TABLE I

| Col. Sel. Signal | BLK Signal | OE bar Signal | PC bar Signal | Output Signal |
|---|---|---|---|---|
| X | X | H | X | Z |
| H | L | L | H | H |
| H | L | L | L | L |

Consequently, referring to FIGS. 6A–6J, in a case where EL elements are driven in the negative field, the PC bar signal is at a low level in the charging period, during which the OE bar signal is at a low level, and so the output signal of the selected line, i.e., the scan voltage (see FIG. 6J), becomes a low level voltage (in this case, −Vr+Vm), and charging of the EL elements is performed.

Additionally, the charging period ends, and output signals go to high impedance in the holding period, during which the OE bar signal goes high, and so the voltage with which the EL elements were charged is held. Herein, in the above-described charging period, a potential gradient is produced due to the patterning resistance of the electrodes and the capacitance of the EL elements, and voltage may not be applied at EL elements distant from the scan electrode terminal, but a shift in charge occurs in this holding period, and EL elements on a single scan line come to have the same voltage. Because of this, the output signal tends to return to 0 V . Consequently, the charging voltage of the several EL elements becomes equal, and so uneven luminance on one scan line can be eliminated.

Additionally, the holding period ends, and the PC bar signal goes high in the discharging period, during which the OE bar signal goes low, and so the selected line output signals come to be voltage of high level (in this case, 0 V ), and discharging of the EL elements is performed.

Consequently, according to the foregoing structure, scan voltage changed by the charging period for charging the EL elements in accordance with the number of light emitting pixels is created at a uniform pulse width, and so uneven luminance between lines can be eliminated, even when a difference exists in the number of light emitting pixels in the several lines.

Additionally, in the positive field, the level of the PC bar signal is the opposite of the case of the negative field, and so in the charging period the scan voltage becomes a voltage of high level (in this case, Vr), and charging of the EL elements is performed, and in the discharging period the scan voltage becomes a voltage of low level (in this case, 0 V ), and discharging of the EL elements is performed.

Additionally, according to the foregoing embodiment, a device which varied the charging period and uniformly regulated the charging charge quantity for the several EL elements was shown, but the charging charge quantity may be made uniform by another structure, such as by adjusting the voltage of the scan voltage and keeping the charging charge quantity to be uniform, and so on.

Figure 8:
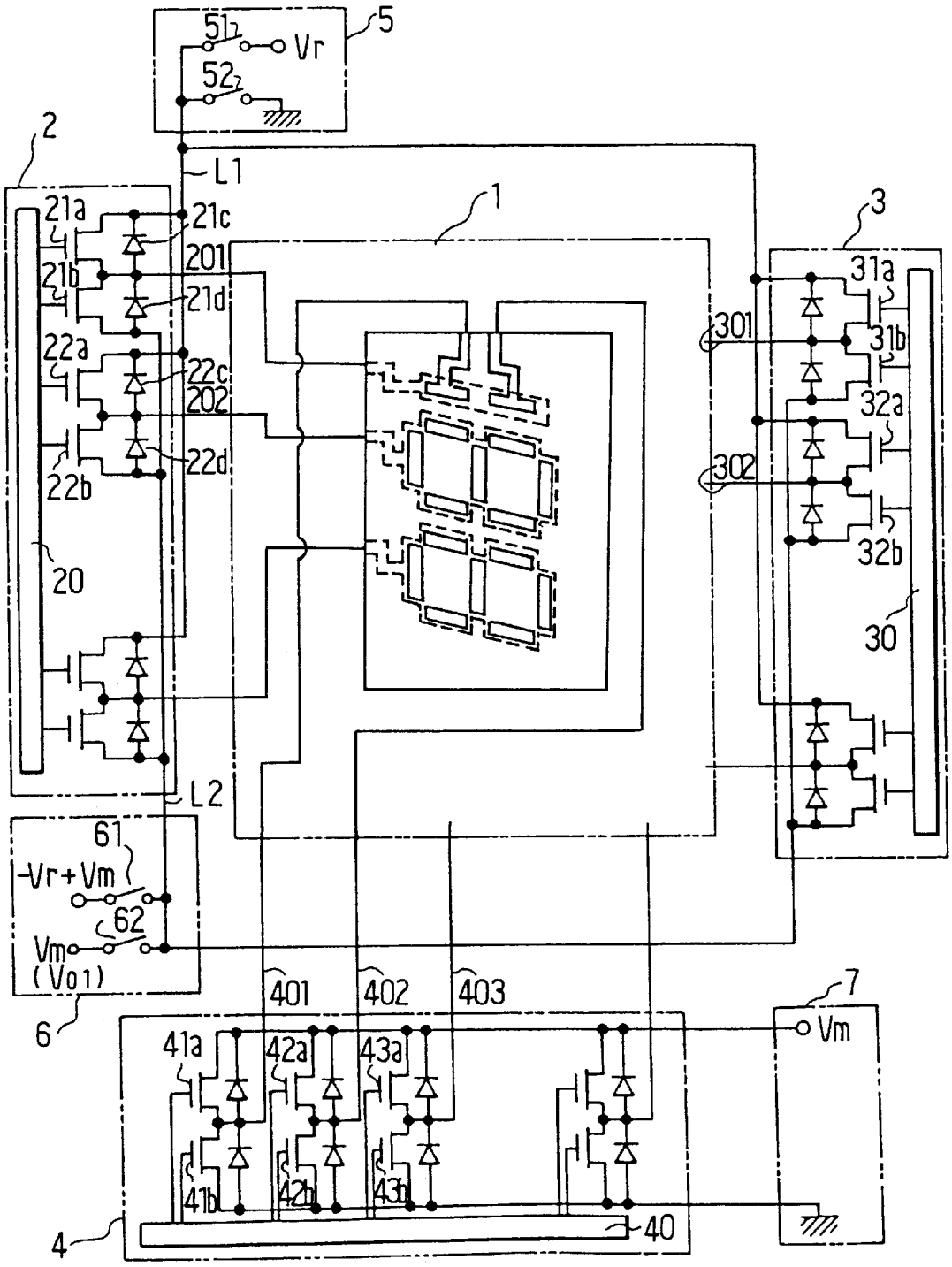

Although the present invention has been fully described in connection with the preferred embodiment thereof with reference to the accompanying drawings, it is to be noted that various changes and modifications will become apparent to those skilled in the art. For example, this invention is not restricted to the above-described EL display device of matrix type, but may be similarly applied even in a case of a segmented display as shown in FIG. 8. In this case, voltage pulses having a charging period and a holding period similar to the foregoing are applied with respect to a common electrode, and in that case, the charging period is varied in accordance with the number of segments which are to emit light. Such changes and modifications are to be understood as being included within the scope of the present invention as defined by the appended claims.

What is claimed is:

1. An EL display device comprising:

an EL display panel having an electroluminescing layer interposed between a plurality of scan electrodes and a plurality of data electrodes, a plurality of EL elements being formed at locations where said scan electrodes and said data electrodes intersect;

first voltage applying means for sequentially applying a voltage pulse to said plurality of scan electrodes; and second voltage applying means for selectively applying a display voltage to said plurality of data electrodes;

wherein said plurality of EL elements are for emitting light by application of said voltage pulse and said display voltage; and said first voltage applying means is for applying said voltage pulse to said plurality of scan electrodes by charging said plurality of EL elements during a charging period and holding a charging voltage thereof for a holding period, for detecting a number of EL elements which are to emit light by application of said voltage pulse and said display voltage, and for varying said charging period in accordance with said number of detected EL elements;

said first voltage applying means is further for holding said charging voltage by causing said plurality of scan electrodes to go to high impedance.

2. The device of claim 1, wherein said first voltage applying means is further for maintaining an overall period of said charging period and said holding period to be uniform.

3. The device of claim 2, wherein said first voltage applying means is for establishing said charging period to be at least a minimum period.

4. The device of claim 3, wherein said first voltage applying means is for restricting said charging period so that it does not exceed a maximum period.

5. The device of claim 2, wherein said first voltage applying means is for restricting said charging period so that it does not exceed a maximum period.

6. The device of claim 1, wherein said first voltage applying means is for establishing said charging period to be at least a minimum period.

7. The device of claim 6, wherein said first voltage applying means is for restricting said charging period so that it does not exceed a maximum period.

8. The device of claim 1, wherein said first voltage applying means is for restricting said charging period so that it does not exceed a maximum period.

9. An EL display device comprising:

an EL display panel having an electroluminescing layer interposed between a plurality of scan electrodes and a plurality of data electrodes, a plurality of EL elements being formed at locations where said scan electrodes and said data electrodes intersect;

first voltage applying means for sequentially applying a voltage pulse to said plurality of scan electrodes; and second voltage applying means for selectively applying a display voltage to said plurality of data electrodes;

wherein said plurality of EL elements are for emitting light by application of said voltage pulse and said display voltage; and said first voltage applying means is for applying said voltage pulse to said plurality of scan electrodes by charging said plurality of EL elements during a charging period and holding a charging voltage thereof for a holding period, for detecting a number of EL elements which are to emit light by application of said voltage pulse and said display voltage, and for changing a charging charge quantity in a case where said charging is performed in accordance with said number of detected EL elements;

said first voltage applying means is further for holding said charging voltage by causing said plurality of scan electrodes to go to high impedance.

10. An EL display device comprising:

an EL display panel having an electroluminescing layer interposed between a plurality of scan electrodes and a plurality of data electrodes, a plurality of EL elements being formed where said scan electrodes and said data electrodes intersect;

means for driving said scan electrodes to sequentially apply a scan voltage to said plurality of scan electrodes; and means for driving data electrodes to selectively apply a data voltage to said plurality of data electrodes;

wherein said plurality of EL elements are for emitting light by application of said scan voltage and said data voltage;

said scan electrode driving means is for applying a scan voltage of uniform pulse width to said plurality of scan electrodes by charging said plurality of EL elements during a charging period and holding a charging voltage thereof for a holding period, for detecting a number of EL elements which are to emit light by application of said scan voltage and said data voltage, and for varying said charging period in accordance with said number of detected EL elements;

said scan electrode driving means is further for holding said charging voltage by causing said plurality of scan electrodes to go to high impedance.

11. An EL display device comprising:

an EL display panel having an electroluminescing layer interposed between a plurality of scan electrodes and a plurality of data electrodes, a plurality of EL element being formed at locations where said scan electrodes and said data electrodes intersect;

first voltage applying means for sequentially applying a voltage pulse to said plurality of scan electrodes; and second voltage applying means for selectively applying a display voltage to said plurality of data electrodes;

said first voltage applying means includes a first switch for opening and closing a path between a constant voltage source and said scan electrodes, and a second switch for opening and closing a path between a voltage point differing from said constant voltage source and said scan electrodes, and said EL elements are actuated by connecting said constant voltage source and said scan electrodes during a period from operation of said first switch until operation of said second switch in a negative field operation of said first voltage applying means and during a period from operation of said second switch until operation of said first switch in a positive field operation of said first voltage applying means; and said first voltage applying means is for detecting a number of EL elements which are to emit light by application of said voltage pulse and said display voltage, and is for controlling an actuation timing of said first switch and said second switch in accordance with said number of detected EL elements.

12. The device of claim 11, wherein a voltage of said constant voltage is a uniform voltage while said first switch and said second switch are actuated.

13. The device of claim 1, further comprising:

a first power source for supplying voltage to said first voltage applying means through a first supplying path; and a second power source for supplying voltage differing from voltage supplied from said first power source to said first voltage applying means through a second supplying path;

wherein said first voltage applying means is for holding said charging voltage by causing said plurality of scan electrodes to go to high impedance within a voltage range between voltage supplied from said first power source and voltage supplied from said second power source.

14. The device of claim 9, further comprising:

a first power source for supplying voltage to said first voltage applying means through a first supplying path; and a second power source for supplying voltage differing from voltage supplied from said first power source to said first voltage applying means through a second supplying path;

wherein said first voltage applying means is for holding said charging voltage by causing said plurality of scan electrodes to go to high impedance within a voltage range between voltage supplied from said first power source and voltage supplied from said second power source.

15. The device of claim 10, further comprising:

a first power source for supplying voltage to said means for driving said scan electrodes through a first supplying path; and a second power source for supplying voltage differing from voltage supplied from said first power source to said means for driving said scan electrodes through a second supplying path;

wherein said means for driving said scan electrodes is for holding said charging voltage by causing said plurality of scan electrodes to go to high impedance within a voltage range between voltage supplied from said first power source and voltage supplied from said second power source.

16. The device of claim 13, further comprising:

said first voltage applying means includes a first switch for opening and closing a path between a constant voltage source and said scan electrodes, and a second switch for opening and closing a path between a voltage point differing from said constant voltage source and said scan electrodes, and said EL elements are charged by connecting said constant voltage source and said scan electrodes during a period from operation of said first switch until operation of said second switch; and said first voltage applying means is for detecting a number of EL elements which are to emit light by application of said voltage pulse and said display voltage, and is for controlling an actuation timing of said first switch and said second switch in accordance with said number of detected EL elements.

17. The device of claim 14, further comprising:

said first voltage applying means includes a first switch for opening and closing a path between a constant voltage source and said scan electrodes, and a second switch for opening and closing a path between a voltage point differing from said constant voltage source and said scan electrodes, and said EL elements are charged by connecting said constant voltage source and said scan electrodes during a period from operation of said first switch until operation of said second switch; and said first voltage applying means is for detecting a number of EL elements which are to emit light by application of said voltage pulse and said display voltage, and is for controlling an actuation timing of said first switch and said second switch in accordance with said number of detected EL elements.

18. The device of claim 15, further comprising:

said means for driving said scan electrodes includes a first switch for opening and closing a path between a constant voltage source and said scan electrodes, and a second switch for opening and closing a path between a voltage point differing from said constant voltage source and said scan electrodes, and said EL elements are charged by connecting said constant voltage source and said scan electrodes during a period from operation of said first switch until operation of said second switch; and said means for driving said scan electrodes is for detecting a number of EL elements which are to emit light by application of said voltage pulse and said display voltage, end is for controlling an actuation timing of said first switch and said second switch in accordance with said number of detected EL elements.

19. An EL device comprising:

an EL display panel having an electroluminescing layer interposed between a plurality of scan electrodes and a plurality of data electrodes, a plurality of EL elements being formed at locations where said scan electrodes and said data electrodes intersect;

first voltage applying means for sequentially applying a voltage pulse to said plurality of scan electrodes by inputting electric current; and second voltage applying means for selectively applying a display voltage to said plurality of data electrodes by inputting electric current;

wherein said plurality of EL elements are for emitting light by application of said voltage pulse and said display voltage; and said first voltage applying means is for applying said voltage pulse to said plurality of scan electrodes by charging said plurality of EL elements during a charging period, and then stopping the electric current input to the plurality of scan electrodes and holding a charging voltage thereof for a holding period, for detecting a number of EL elements which are to emit light by application of said voltage pulse and said display voltage, and for varying said charging period in accordance with said number of detected EL elements.

* * * * *